US005144898A

United States Patent [19]

Posly

[11] Patent Number: 5,144,898

[45] Date of Patent: Sep. 8, 1992

[54] ADJUSTABLE TABLE

[76] Inventor: Louis M. Posly, 243- Lidy Rd., Dupont, Pa. 18641

[21] Appl. No.: 683,092

[22] Filed: Apr. 10, 1991

Related U.S. Application Data

[63] Continuation of Ser. No. 426,114, Oct. 24, 1989, abandoned.

[51] Int. Cl.[5] ..... A47B 5/00

[52] U.S. Cl. ..... 108/148; 108/49

[58] Field of Search ..... 108/148, 95, 104, 105, 108/139, 94, 140, 141, 143; 248/296, 349; 403/59, 80

[56] References Cited

U.S. PATENT DOCUMENTS

| | | | |
|---|---|---|---|
| 355,911 | 1/1887 | Bartow, Jr. | 108/49 X |
| 529,210 | 11/1894 | Storz et al. | 108/49 X |
| 1,220,578 | 3/1917 | Wise | 108/49 X |
| 1,232,757 | 6/1917 | Berkey | 108/148 X |
| 1,653,657 | 12/1927 | Pretsch | 108/49 X |
| 1,797,847 | 3/1931 | Vandagriff | 108/49 |
| 1,862,237 | 6/1932 | Pepler | 108/49 |
| 2,293,496 | 8/1942 | Egger | 108/140 X |
| 2,710,051 | 6/1955 | Greenberg | 108/49 X |
| 3,033,627 | 5/1962 | Brown et al. | 108/148 X |
| 3,054,122 | 9/1962 | Sarkus | 108/49 |
| 3,207,099 | 9/1965 | Black et al. | 108/49 X |
| 3,615,068 | 10/1971 | Edelstein | 240/349 |

FOREIGN PATENT DOCUMENTS

| | | | |
|---|---|---|---|
| 798784 | 5/1936 | France | 108/49 |
| 25563 | of 1913 | United Kingdom | 108/140 |

*Primary Examiner*—Jose V. Chen

*Attorney, Agent, or Firm*—Kane, Dalsimer, Sullivan, Kurucz, Levy, Eisele and Richard

[57] ABSTRACT

An adjustable table intended to be mounted to any chair is disclosed and claimed herein. The table top possesses the following degrees of movement: it is adjustable vertically, it is rotatable about its vertical support, rotatable, it is slideable about its horizontal support, and can flip about a hinge at one end of the horizontal supports. The table top is adjustable in the above degrees of movement, which permits the users to easily adjust the table top location to his or her liking.

8 Claims, 5 Drawing Sheets

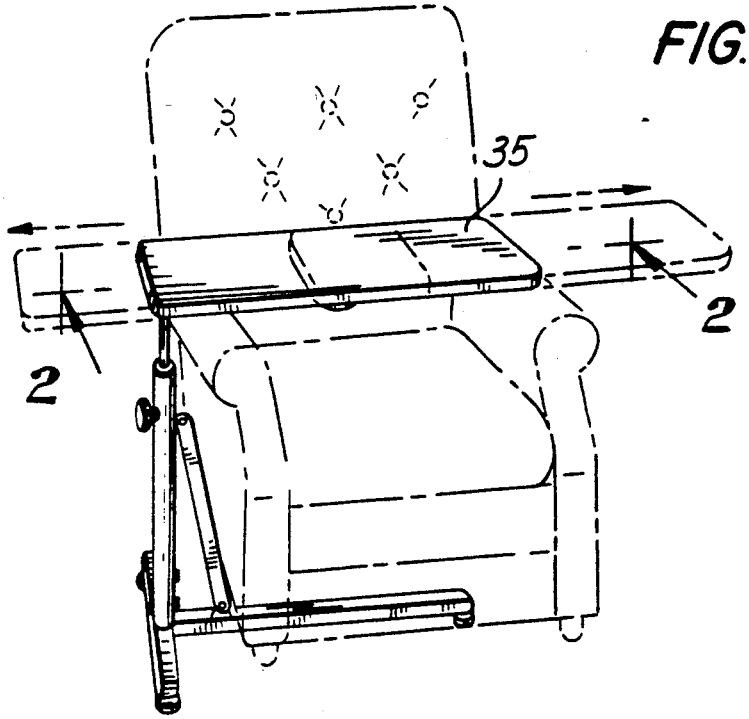
FIG. 1
FIG. 3
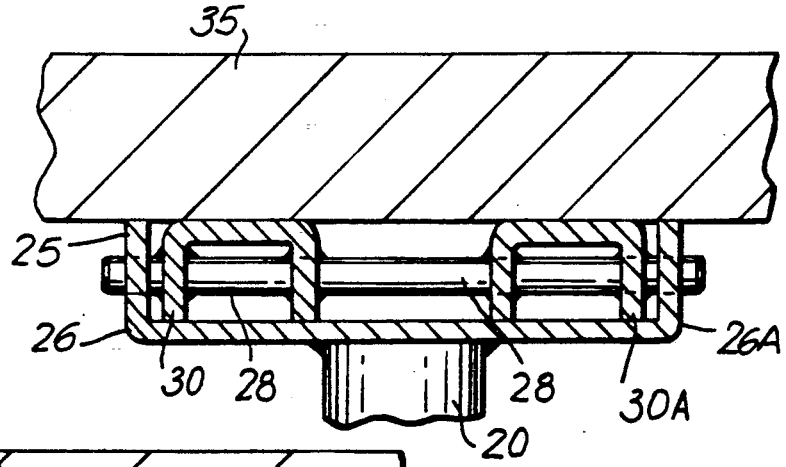
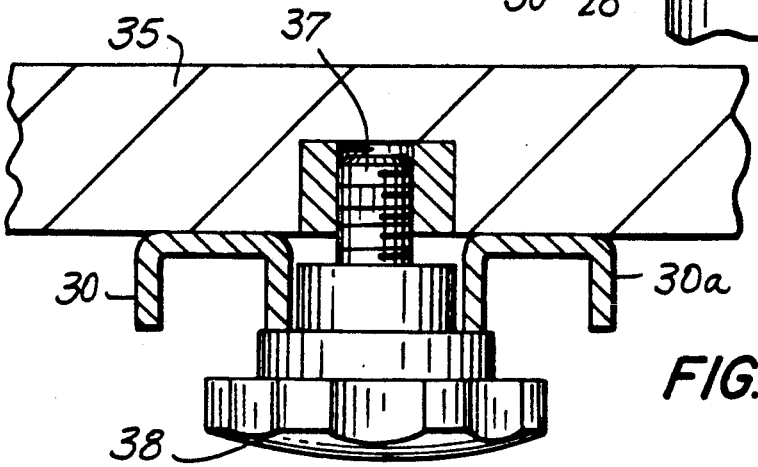
FIG. 4

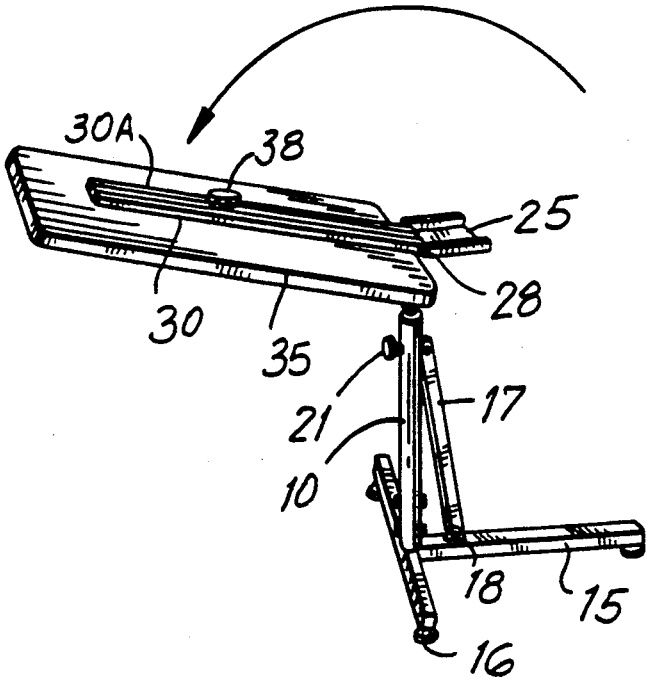
FIG. 7
FIG. 8
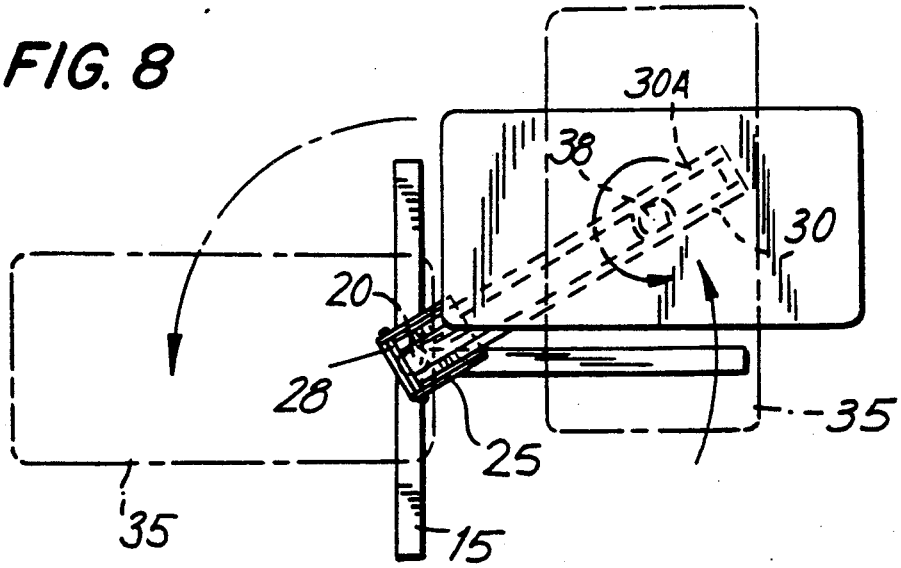
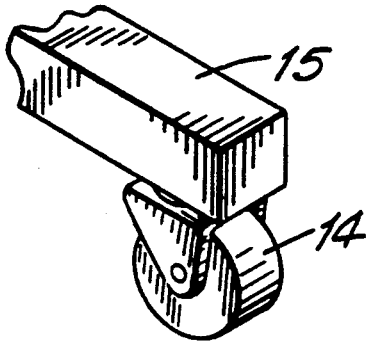
FIG. 9

ADJUSTABLE TABLE

This is a continuation of copending application Ser. No. 0/426,114 filed on Oct. 24, 1989 now abandoned.

BACKGROUND OF THE INVENTION

Tables exist which permit those who are elderly, infirm or those who otherwise are limited in their movement to eat or engage in other activities from bedside or a chair. However, most of these are of the bedside variety, not for attachment to an ordinary chair or a lift chair. However, there is such a table disclosed in U.S. Pat. No. 2,625,986, which shows a table mountable to a chair. It appears that this table is somewhat cumbersome in usage because it does not adjust in height and in other degrees of movement. Depending upon the size of the person and the dimensions of the chair, the practical use of this table may be so problematic as it obviate any convenience it purports to render.

SUMMARY OF THE INVENTION

It is an object of the present invention to provide a table mountable to any chair which is fully adjustable in the horizontal and vertical planes.

It is a further object of the invention to provide a table top which can be rotated and fixed in place.

It is a further object of the invention to provide a table whose top can be flipped away from the chair when not in use.

Other objects of the invention shall become apparent from the descriptions contained herein.

The table of the present invention possess up to five separate degrees of movement. It can be adjusted vertically in height along its vertical mount, as well as rotate about this point. The table top can slide along its horizontal mounting table provides a convenient table top means for its user, as he or she can set the table top to the front (over the lap) or to the side of the chair, while permitting adjustment to the user's liking.

BRIEF DESCRIPTION OF THE DRAWINGS

FIG. 1 is a perspective view of the table as it is attached to a chair.

FIG. 3 is a cross sectional view of the hinge and mounting member.

FIG. 4 is a cross sectional view of the means for mounting the table top.

FIG. 7 is a perspective view showing the flipping of the table top.

FIG. 8 is a perspective view showing the pivotal adjustment of the table top.

FIG. 9 is a perspective view of the base and caster arrangement.

DETAILED DESCRIPTION OF THE PREFERRED EMBODIMENT

Figures 2, 5:
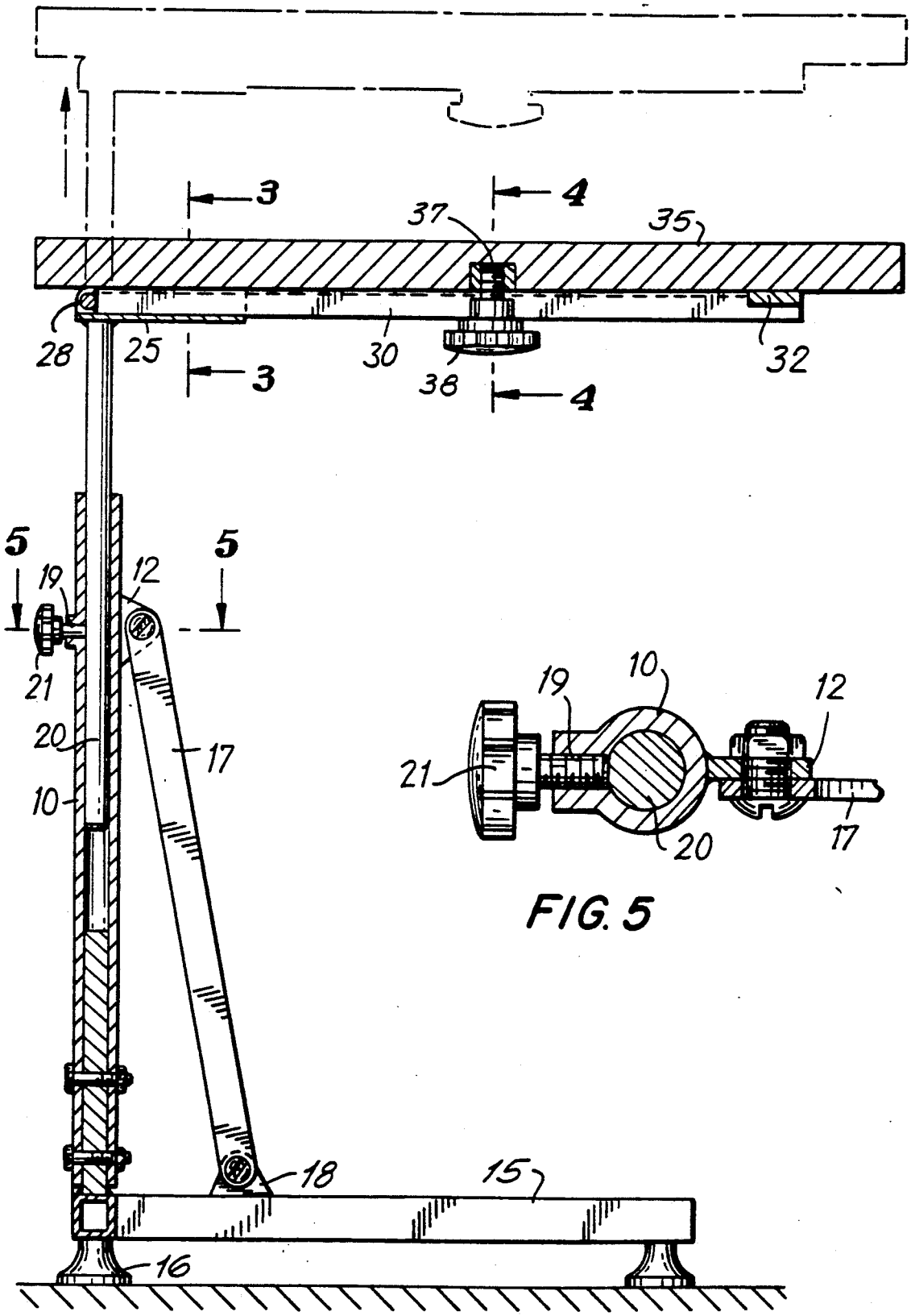
FIG. 2 is a side view of the assembled table, illustrating vertical adjustment.
FIG. 5 is a planar view along lines 5—5 showing the means for clamping the support tube within the upright.
Figure 6:
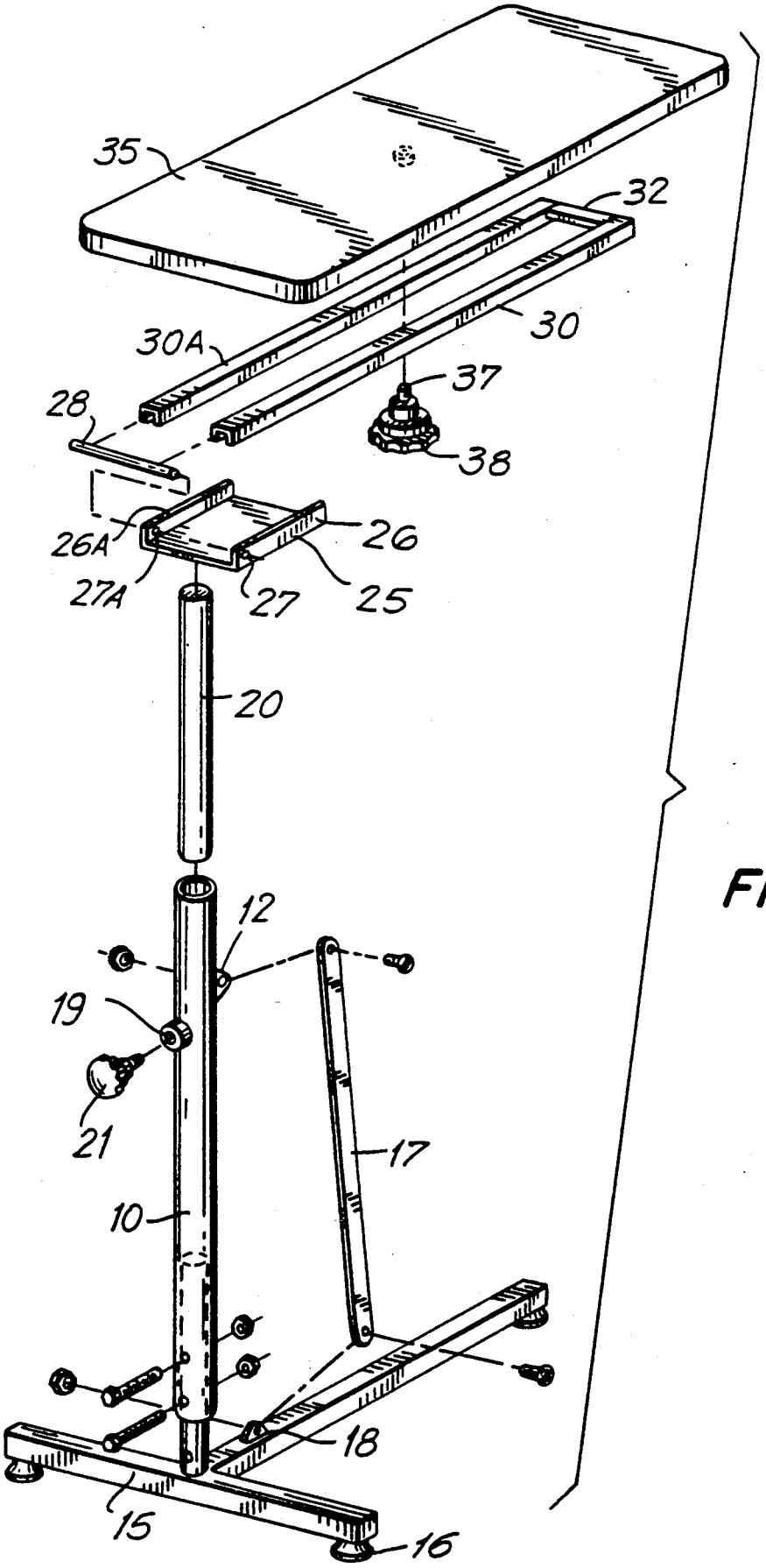
FIG. 6 is an exploded view showing the inter-relationship of the individual parts of the table.

The table comprises an upright 10 which is mounted at its bottom to a T-shaped base 15. It should be noted that the base may take an form known by those skilled in the art. Upon one extension of the T-shaped base is an angled support member 17 attached to the T-shaped base at 18 which at its other end is attached to the upright 10 at point 12. The T-shaped base possesses either casters 14 or feet 16 as supports.

The upright member 10 is hollow tube in which a vertical support tube 20, having a smaller outside diameter than the inside diameter of the upright, slides within. The vertical support member 20 and the upright 10 form telescoping members which permit the vertical adjustment of the table, as well as permitting its ability to rotate about its vertical axis. The upright member 10 has a threaded aperture 19 through which a clamping member 21 in the form of a threaded screw and knob is located as the means for setting the vertical height and rotation of the table.

At the top of the vertical support member is the mounting plate 25. In the preferred embodiment the mounting plate and the vertical support members are welded together, but in other embodiments may be formed of a unitary construction or mounted by other means known in the art. The mounting plate 25 has two sidewalls 26 and 26A opposite each other, each of which has an aperture 27 and 27A opposite the other.

Two track members 30 and 30A which run horizontally are fitted within the mounting plate 25 and run perpendicular to the vertical support member 20. A cross piece 32 at the end opposite the mounting plate is mounted to each of the horizontal track members 30 and 30A by any known means such as welding serves to add stability and structural support to the horizontal track members.

Mounting member 25 has two apertures 27 and 27A opposite each other in the side walls 26 and 26A, through which a hinge member 28 is mounted therein. The horizontal track members 30 and 30A are welded to the hinge member 28. This permits the horizontal track members to flip about the hinge 28, as can best be seen in FIG. 7.

The table top 35 is mounted to the horizontal track members by means of a screw and knob arrangement. Embedded within the underside of the table top is a screw 37 having its threaded end protruding outwardly. When the table top is placed upon the horizontal track so that the screw is between the horizontal track members, it may be moved horizontally along the track, as well as rotated about the track. Its position maybe fixed by means of a knob 38 having a threaded aperture which receives the threaded screw. By tightening the knob the horizontal track members become clamped between the knob and table top, fixing the table top in place.

The table top of the preferred embodiment is adjustable in the five ways set forth above, and depicted in FIGS. 2, 7 and 8. In FIG. 1, the table top is shown sliding from side to side along 2—2. And if the user so desires, he or she can pivot it about either the vertical support member 20 so that the table top is at the user's side, adjacent to the table. Therefore, a table top is disclosed permitting ease of adjustment in various degrees of movement.

Figure 11:
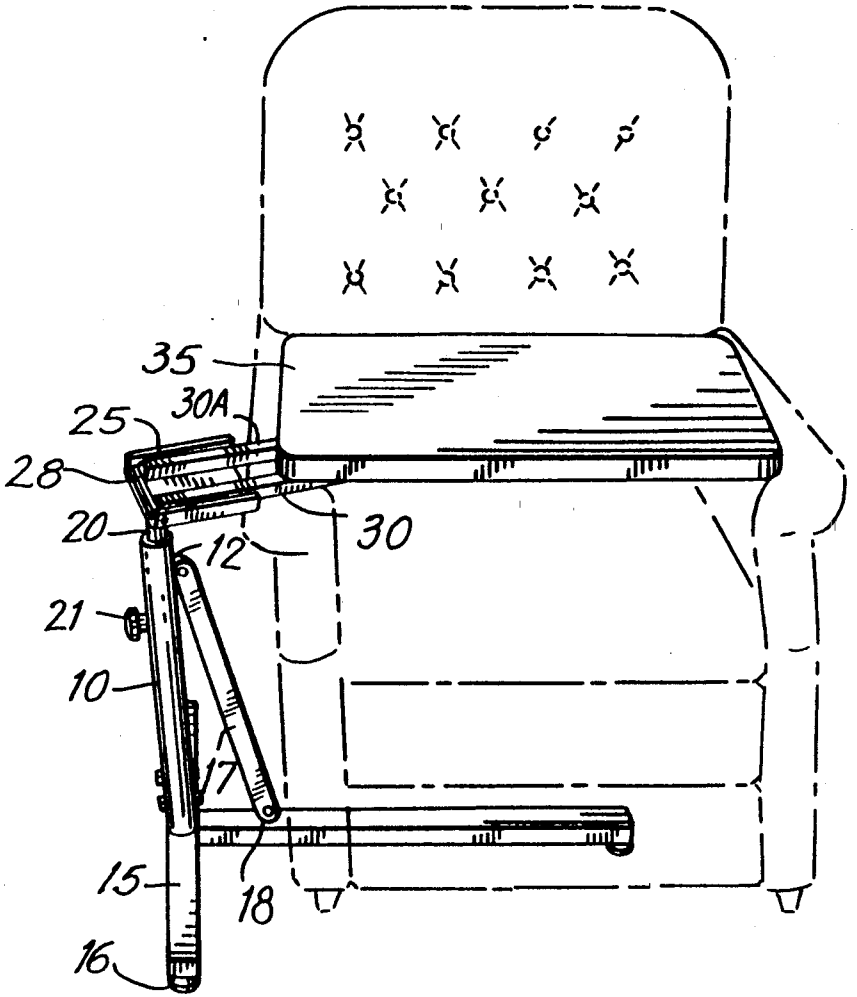
FIG. 11 is a perspective view showing the table top positioned in an extended position along the horizontal track members.
Figure 10:
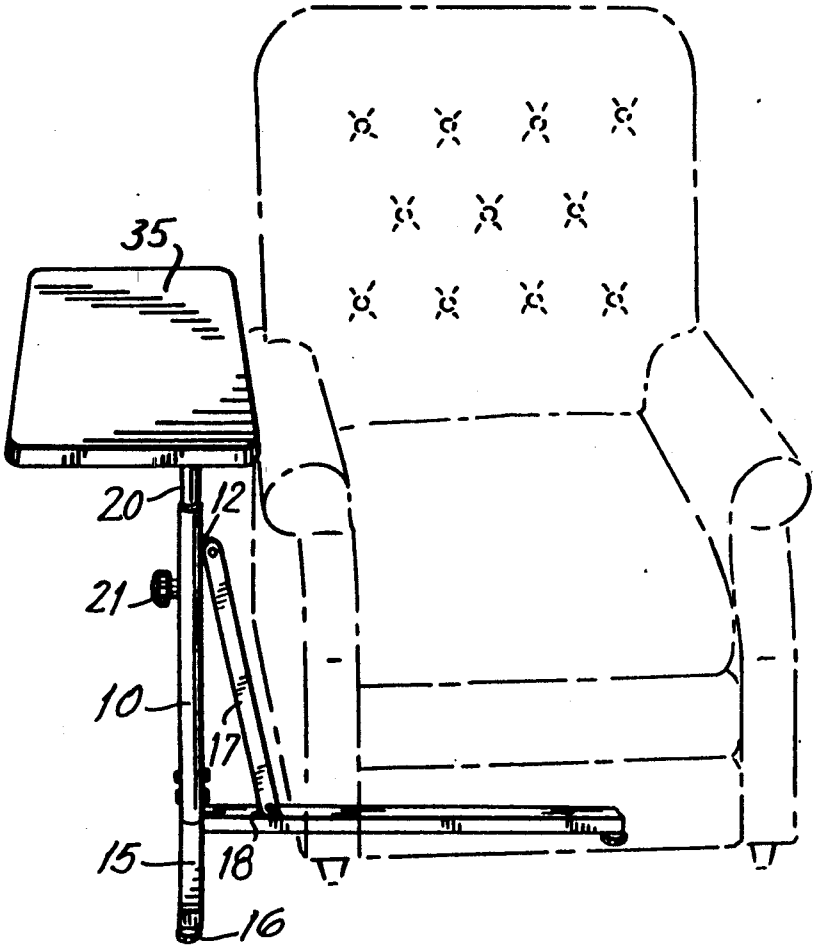
FIG. 10 is a perspective view showing the table top positioned adjacent to the chair to be at the user's side.

In FIG. 10, a positioning of the table top adjacent to the chair is depicted. In FIG. 11, it is shown that the table top is slideably adjustable along the horizontal track members, permitting the table top to be extendably positioned along the track members.

I claim:

1. An adjustable table comprised of support means, a table top, said table top mounted upon at least one horizontal member, said adjustable table having upper and lower members in telescoping arrangement articulated to the support means and to the horizontal member for the vertical adjustment of the table top relative to the support means and further comprising means for pivotal adjustment of the table top about the support means, said table top being slideably adjustable about the horizontal member for horizontal adjustment about the horizontal member and rotatably adjustable about the horizontal member, the horizontal member also being mounted to flipping means that are also mounted to the support means, said flipping means permitting the table top to be flipped and wherein a mounting plate is welded to the top of the vertical support member, said mounting plate having means for the receipt of one or more track members, said mounting plate is comprised of sidewalls having apertures therein, a hinge member fitted within the aperture of the side walls, means for securing said hinge member in place, and said horizontal members are welded to the hinge member, permitting said horizontal members to flip about the hinge, and wherein the table top is positionable over the user's lap or over the user's side.

2. An adjustable table as set forth in claim 1 wherein the lower member of the telescoping arrangement is mounted to a base and the upper of which is adjustable, thereby providing means for vertically adjusting the table, and means for clamping the upper adjustable telescoping member.

3. The adjustable table as set forth in claim 2 wherein a mounting member is attached to the upper adjustable telescoping member and said at least one horizontal member is mounted to said mounting member.

4. An adjustable table as set forth in claim 3 further comprised of means for selectively fixing the table top at a point along the length of the horizontal member, thereby permitting the horizontal adjustment of the table top along the length of the horizontal member.

5. An adjustable table according to claim 4 wherein the base is a T-shaped base.

6. An adjustable table according to claim 5 wherein the outermost telescoping member has a threaded aperture at a point along its length, and a threaded screw is fitted therein as the clamping means for fixing the adjustable member in place.

7. An adjustable table according to claim 6 wherein the telescoping members are comprised of an upright attached to the base and a vertical support member fitted within the upright, the vertical support member being vertically and pivotally adjustable.

8. An adjustable table comprising a means for providing upright stability for the adjustable table, vertical upper and lower members forming a telescoping arrangement, the lower member being in fixed engagement with the upright stability providing means, the upper member being vertically adjustable with respect to the upright stability providing means, means for clamping the upper adjustable telescoping member, at least one track member mounted to a mounting member, means for joining the upper adjustable telescoping member and the mounting member, and a table top, said table top being engaged to the track member, to permit the table top to be moved and adjusted horizontally about the track member and moved rotationally about the track member, means for selectively fixing the table top at a point along the length of the track member, means for forming a hinge between the mounting member and the horizontal member thereby permitting the table top to be flipped about the hinge, and said table top also being pivotally adjustable about the telescoping arrangement of the upright stability providing means.

* * * * *